US006693619B1

(12) United States Patent
Miura et al.

(10) Patent No.: US 6,693,619 B1
(45) Date of Patent: Feb. 17, 2004

(54) LIQUID CRYSTAL DISPLAY APPARATUS AND METHOD THEREFOR

(75) Inventors: Shinichiro Miura, Kanagawa (JP); Kazuhiro Nakagomi, Chiba (JP)

(73) Assignee: Sony Corporation, Tokyo (JP)

( * ) Notice: Subject to any disclaimer, the term of this patent is extended or adjusted under 35 U.S.C. 154(b) by 115 days.

(21) Appl. No.: 09/697,686

(22) Filed: Oct. 26, 2000

(30) Foreign Application Priority Data

Oct. 28, 1999 (JP) ..... 11-307541

(51) Int. Cl.[7] ..... G09G 3/36
(52) U.S. Cl. ..... 345/102; 345/98
(58) Field of Search ..... 345/102, 87, 213, 345/148, 211; 315/158

(56) References Cited

U.S. PATENT DOCUMENTS 5,838,294 A * 11/1998 Praiswater ..... 345/102
5,844,540 A * 12/1998 Terasaki ..... 345/102
6,008,929 A * 12/1999 Akimoto et al. ..... 345/102
6,232,963 B1 * 5/2001 Tew et al. ..... 345/102
6,268,844 B1 * 7/2001 Jun ..... 345/102
6,292,182 B1 * 9/2001 Park et al. ..... 345/211
6,340,970 B1 * 1/2002 Furuhashi et al. ..... 345/213
6,380,932 B1 * 4/2002 Kawasaki et al. ..... 345/102

* cited by examiner

*Primary Examiner*—Vijay Shankar
*Assistant Examiner*—Nitin Patel
(74) *Attorney, Agent, or Firm*—Jay H. Maioli

(57) ABSTRACT

A liquid crystal display apparatus includes a liquid crystal module for displaying an image thereon, a backlight for emitting light from the rear surface of the liquid crystal module, and an inverter for controlling the backlight. The inverter drives the backlight at a predetermined oscillation frequency, based on pulse signals which are pulse-width modulated and are in synchronization with vertical synchronization signals. The backlight is turned off while the liquid crystal module is being scanned for an image of the next field to be displayed, and is turned on when the scanning is complete and the liquid crystal module is ready to display the refreshed image. Accordingly, undesirable afterimages such as trailing do not appear in moving images.

8 Claims, 6 Drawing Sheets

LIQUID CRYSTAL DISPLAY APPARATUS AND METHOD THEREFOR

BACKGROUND OF THE INVENTION

1. Field of the Invention

The present invention generally relates to a liquid crystal display apparatus and to a method therefor, and more specifically the present invention relates to the control of the backlight in a liquid crystal display apparatus.

2. Description of the Related Art

Recently, liquid crystal display apparatuses are used in personal computers, workstations, TV sets, etc. A liquid crystal display apparatus allows either still or moving images to be displayed on a liquid crystal display panel by scanning the liquid crystal display panel in accordance with video signals. The video signals include image data carrying information regarding images to be displayed, and synchronization data which allow synchronous scanning of the liquid crystal panel so as to form images thereon.

The liquid crystal display apparatus, in order to provide brighter images, typically incorporates a backlight on the rear surface of the liquid crystal panel thereof. The backlight is driven by, for example, an inverter circuit, and emits light on the liquid crystal panel from the rear surface thereof. As a light source for the backlight, cold-cathode tubes, which are compact and efficient, may be employed as can conventional fluorescent tubes.

The liquid crystal display apparatus does not have a very rapid response to video signals. Therefore, there is a problem in that trailing of images occurs when moving images are displayed, degrading picture quality.

SUMMARY OF THE INVENTION

Accordingly, it is an object of the present invention to provide a liquid crystal display apparatus and method in which trailing of images is prevented and picture quality is thus improved.

To this end, the present invention, in one aspect thereof, provides a liquid crystal display apparatus having a display control unit for processing video signals; a liquid crystal module, controlled by the display control unit, for displaying an image thereon; a backlight unit for emitting light from a rear surface of the liquid crystal module; a vertical synchronization signal processing unit for generating pulse signals based on vertical synchronization signals of the video signals, the pulse signals being pulse-width modulated and in synchronization with the vertical synchronization signals; and an inverter unit for generating, at a predetermined oscillation frequency, voltages for driving the backlight unit based on the pulse signals.

The present invention, in another aspect thereof, provides a display method for displaying an image on a liquid crystal module in accordance with video signals. The display method includes the steps of generating pulse signals based on vertical synchronization signals of the video signals, the pulse signals being pulse-width modulated and in synchronization with the vertical synchronization signals; generating voltages based on the pulse signals at a predetermined oscillation frequency; and driving, with the voltages, a backlight unit for emitting light from a rear surface of the liquid crystal module.

With these features, the backlight is controlled based on the pulse signals which are in synchronization with the vertical synchronization signals. The backlight is turned off while the liquid crystal module is being scanned for an image of the next field to be displayed, and is turned on when the scanning is complete and the liquid crystal module is ready to display the refreshed image. Accordingly, after-images such as trailing, which tend to arise for moving images, do not appear, and picture quality is thus improved.

DESCRIPTION OF THE PREFERRED EMBODIMENTS

Preferred embodiments of the present invention will now be described in detail with reference to the accompanying drawings.

It is to be understood that, although the present invention is described below in its preferred embodiments having particular features, the described embodiments are only illustrative and are not intended to limit the scope the present invention.

A liquid crystal display apparatus and a method therefor according to a first embodiment of the present invention are described with reference to FIGS. 1 to 5.

Figure 1:
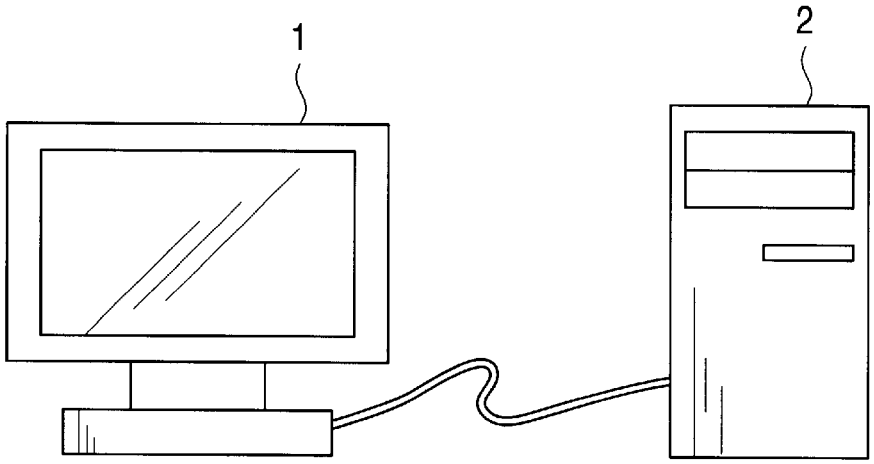
FIG. 1 illustrates an example of the use of a liquid crystal display apparatus according a first embodiment of the present invention.

Referring first to FIG. 1, a liquid crystal display apparatus 1 is connected via, for example, a cable, to a video signal output apparatus 2 which may be a personal computer, a video cassette recorder, a TV tuner, an optical disk drive, or the like. The video signal output apparatus 2 transmits video signals to the liquid crystal display apparatus 1, and also controls the operation of the liquid crystal apparatus 1. The video signals include image data carrying information regarding images to be displayed, and synchronization data which allow synchronous scanning of a liquid crystal module so as to form images thereon.

Figure 2:
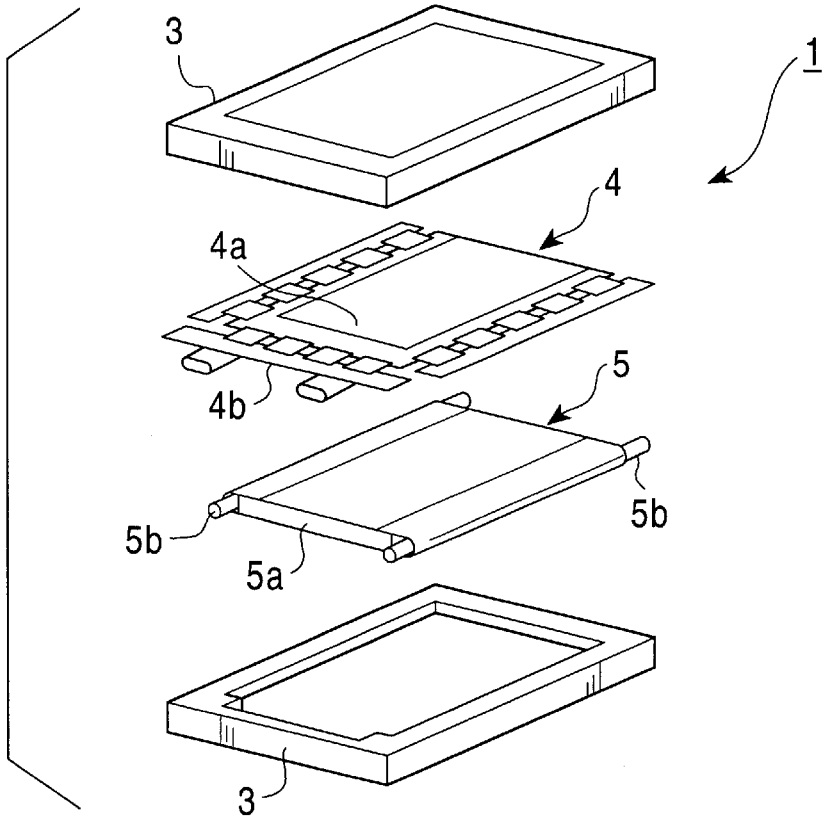
FIG. 2 illustrates, in part, the construction of a liquid crystal display apparatus according to the first embodiment.

Referring now to FIG. 2, the liquid crystal display apparatus 1 includes casings 3, a liquid crystal module 4, and a backlight 5 having a waveguide 5*a* and cold-cathode tubes 5*b*. The casings 3 contain and protect the liquid crystal module 4 and the backlight 5. The liquid crystal module 4 forms images on a display surface 4*a* thereof when scanned in accordance with video signals containing image data and synchronization data. On a rear surface 4*b* of the liquid crystal module 4, there is provided a backlight 5 for emitting light on the liquid crystal module 4, whereby the user is able to view the images.

Figure 3:
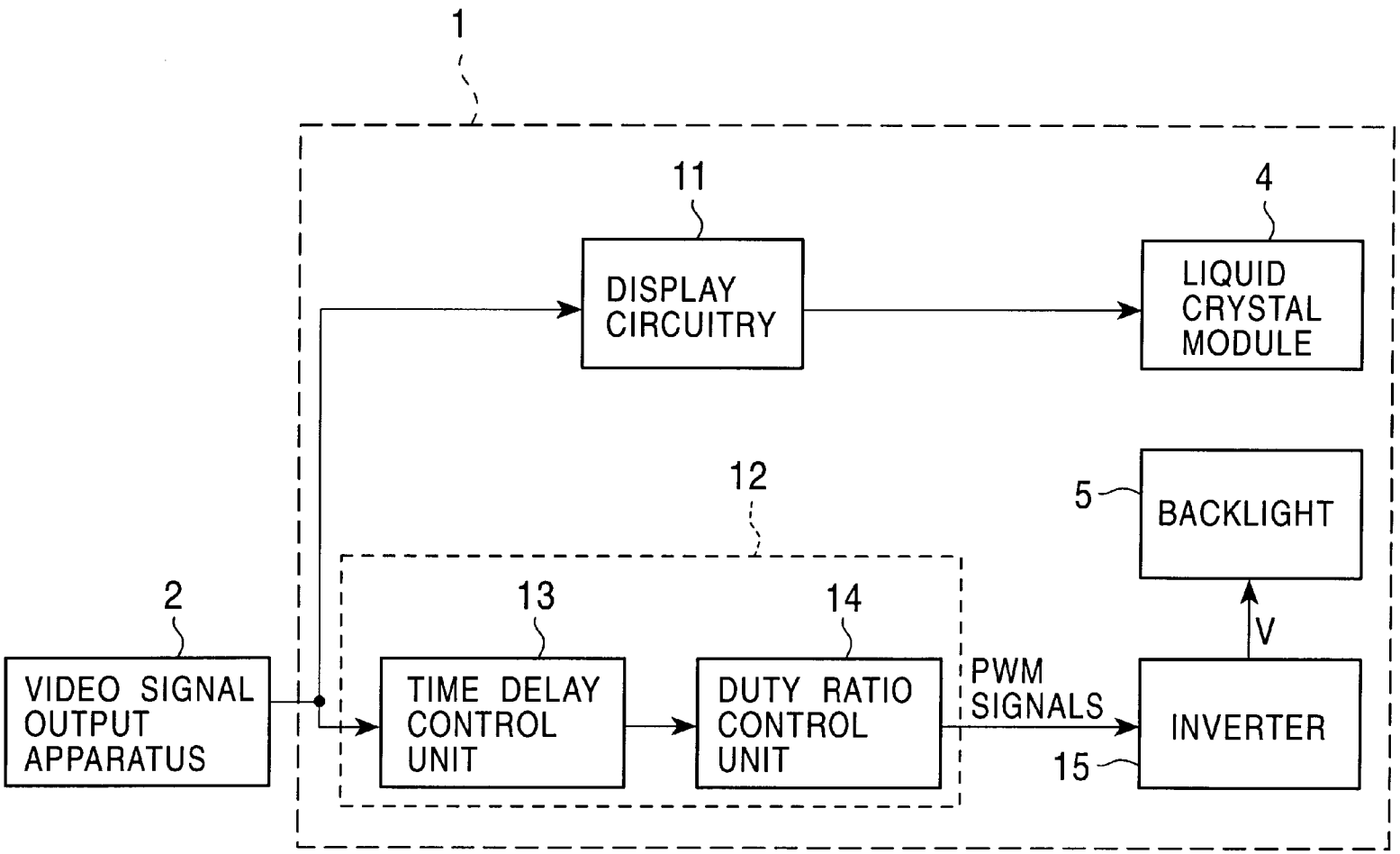
FIG. 3 is a block diagram of the liquid crystal display apparatus according to the first embodiment.

FIG. 3 is a block diagram of the liquid crystal display apparatus 1. Referring to FIG. 3, the liquid crystal display apparatus 1 includes a liquid crystal module 4, a backlight 5, a display circuitry 11, a vertical synchronization signal processing unit 12, and an inverter 15.

The display circuitry 11 is implemented with, for example, an A/D converter, a resolution converter, a drive circuit, etc., and is electrically connected via, for example, a cable, to the liquid crystal module 4. The display circuitry 11 controls output of images on the liquid crystal module 4 in accordance with video signals transmitted from the video signal output apparatus 2.

The vertical synchronization signal processing unit 12 generates pulse-width modulated signals in synchronization with vertical synchronization signals. More specifically, the vertical synchronization signal processing unit 12 includes a time delay control unit 13 and a duty ratio control unit 14, respectively implemented with a one-shot multivibrator for example.

The time delay control unit 13 delays vertical synchronization signals of video signals transmitted from the video signal output apparatus 2, for a predetermined period which is equivalent, for example, to a vertical blanking time of the video signals.

The duty ratio control unit 14 modulates the pulse width of the vertical synchronization signals fed from the time delay control unit 13, and outputs the pulse-width modulated signals in synchronization with the vertical synchronization signals. The pulse width modulation serves to control the brightness of images displayed on the liquid crystal module 4.

The vertical synchronization signal processing unit 12 is controlled so as to operate only when video signals for moving images are received. When video signals for still images are received, the backlight 5 operates at the frequency of the inverter 15, for example, at 200 Hz, without the effects of vertical synchronization signals. Thus, the backlight 5 is controlled as desired in accordance with the type of video signals.

The inverter 15, at a predetermined oscillation frequency, generates voltages in accordance with the pulse-width modulated signals supplied from the duty ratio control unit 14, whereby the backlight 5 is driven.

Figure 4:
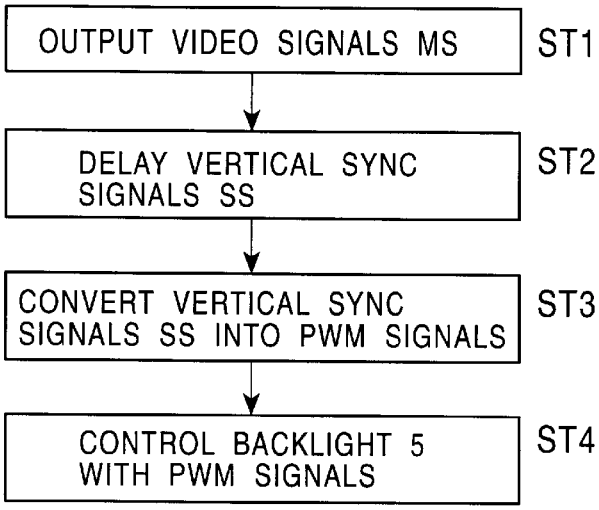
FIG. 4 is a flow chart of a liquid crystal display method according to the first embodiment of the present invention.

FIG. 4 is a flowchart of a liquid crystal display method according to the first embodiment.

In ST1, video signals MS containing image data and synchronization data are transmitted from the video signal output apparatus 2 to the display circuitry 11 and the time delay control unit 13. Then, the display circuitry 11 scans the liquid crystal module 4 in accordance with the image data and with reference to the synchronization data; accordingly images are output on the liquid crystal module 4.

In ST2, when the video signals MS are input to the time delay control unit 13, vertical synchronization signals SS of the video signals MS are delayed for, for example, a vertical blanking time, and are then transmitted to the duty ratio control unit 14. In ST3, the time-delayed vertical synchronization signals undergo pulse width modulation to be converted into pulse-width modulated signals in synchronization with the vertical synchronization signals. In ST4, when the pulse-width modulated signals are transmitted to the inverter 15, the inverter 15 generates voltages in accordance therewith so as to turn the backlight 5 on and off.

Because the inverter 15 operates based on the pulse-width modulated signals which are in synchronization with the vertical synchronization signals, the backlight 5 turns on and off rapidly in synchronization with the vertical synchronization signals. Accordingly, the backlight 5 is turned off while a scan is being performed for an image of the next field to be displayed, and the backlight 5 is turned on when the scan is complete and the image of the next field is ready for display.

Figure 5:
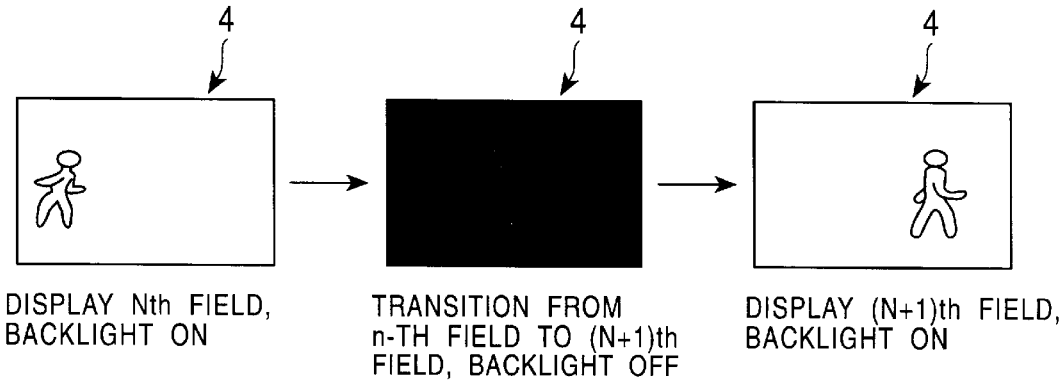
FIG. 5 is a schematic illustration of the liquid crystal display method according to the first embodiment.

Referring to FIG. 5, in the first screen, an image of the n-th field is displayed on the liquid crystal module 4, with the backlight 5 turned on. During a transition from the n-th field to the (n+1)th field, i.e., while a scanning for an image of the (n+1)th field is being performed, the backlight 5 is turned off, as in the second screen. When the scanning is complete, the backlight 5 is turned on so as to display the image of the (n+1)th field, as in the third screen.

While the liquid crystal module 4 is being scanned for the image of the next field to be displayed, the backlight 5 is turned off, hiding the image of the previous field. Therefore, afterimages such as trailing due to slow response of the liquid crystal module 4 does not occur, and picture quality is thus improved.

In addition, because the operation of the backlight 5 is controlled by synchronizing the pulse-width modulated signals with vertical synchronization signals without altering the oscillation frequency of the inverter 15, the picture quality of the liquid crystal display apparatus 1 can be readily improved.

A second embodiment of a liquid crystal display apparatus and a method therefor are described below with reference to FIGS. 6 to 8. Hereinbelow, identical components as in the first embodiment are designated by the same reference characters, and description thereof is omitted.

Figure 6:
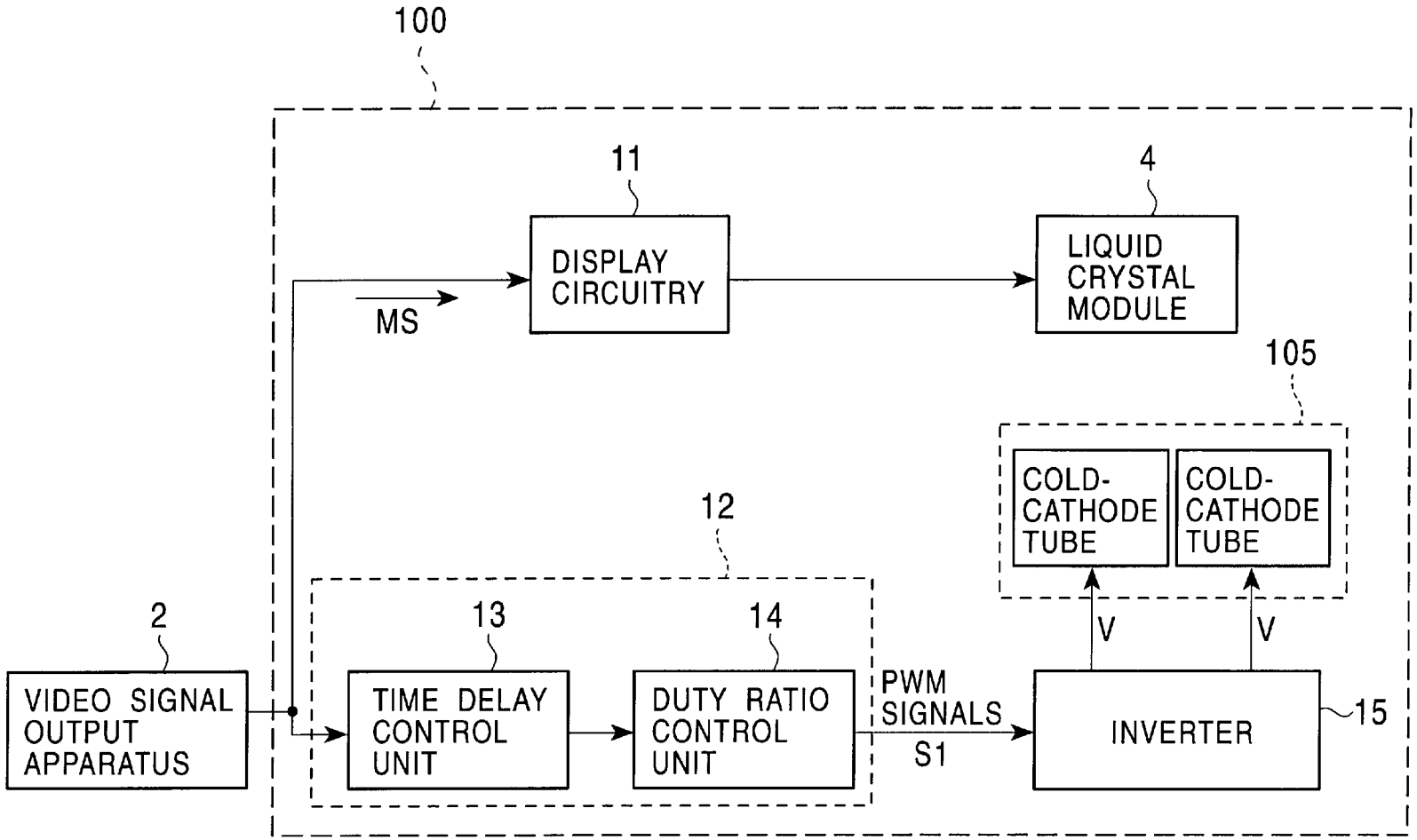
FIG. 6 is a block diagram of a liquid crystal display apparatus according to a second embodiment of the present invention.
Figure 7:
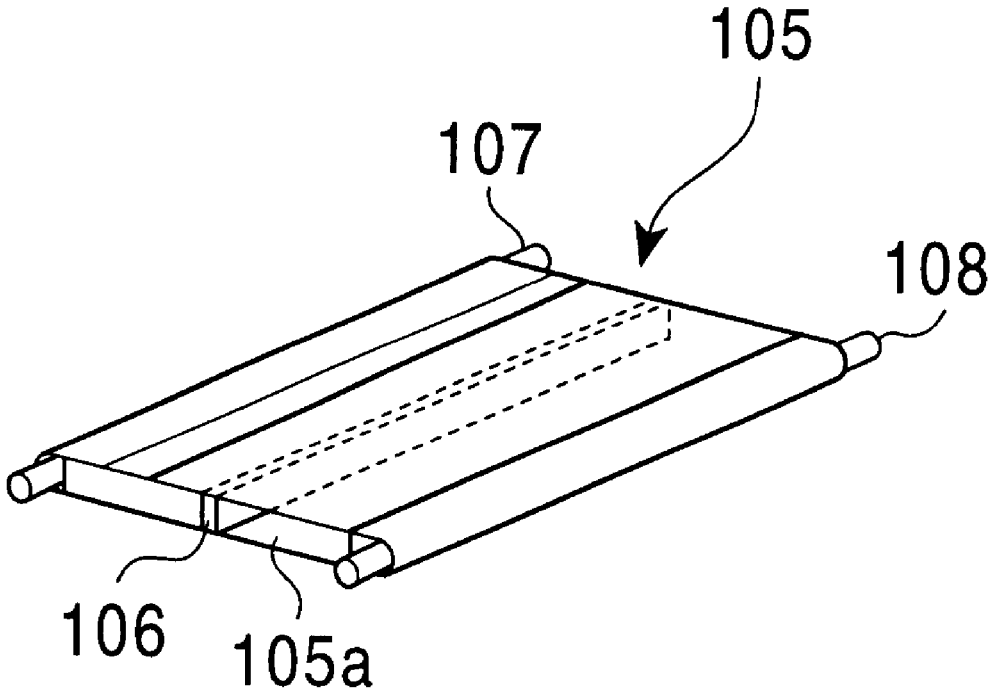
FIG. 7 illustrates the construction of a backlight in the liquid crystal apparatus according to the second embodiment.

FIG. 6 is a block diagram of a liquid crystal display apparatus 100. The liquid crystal display apparatus 100 of the second embodiment differs from the liquid crystal display apparatus 1 of the first embodiment in the construction of the backlight. Referring further to FIG. 7, a backlight 105 of the liquid crystal display apparatus 100 includes a waveguide 105*a*, a light block 106, and a pair of cold-cathode tubes 107 and 108. The cold-cathode tubes 107 and 108 are disposed on opposite ends of the waveguide 105*a* with respect to the light block 106 disposed along the middle of the waveguide 105*a*. Accordingly, light emitted from the cold-cathode tube 107 brightens the half area 4*a* of the liquid crystal module 4 in association therewith, while light emitted from the cold-cathode tube 108 brightens the other half area 4*b*. The cold-cathode tubes 107 and 108 are controlled by the inverter 15 so as to operate independently of each other.

Figure 8:
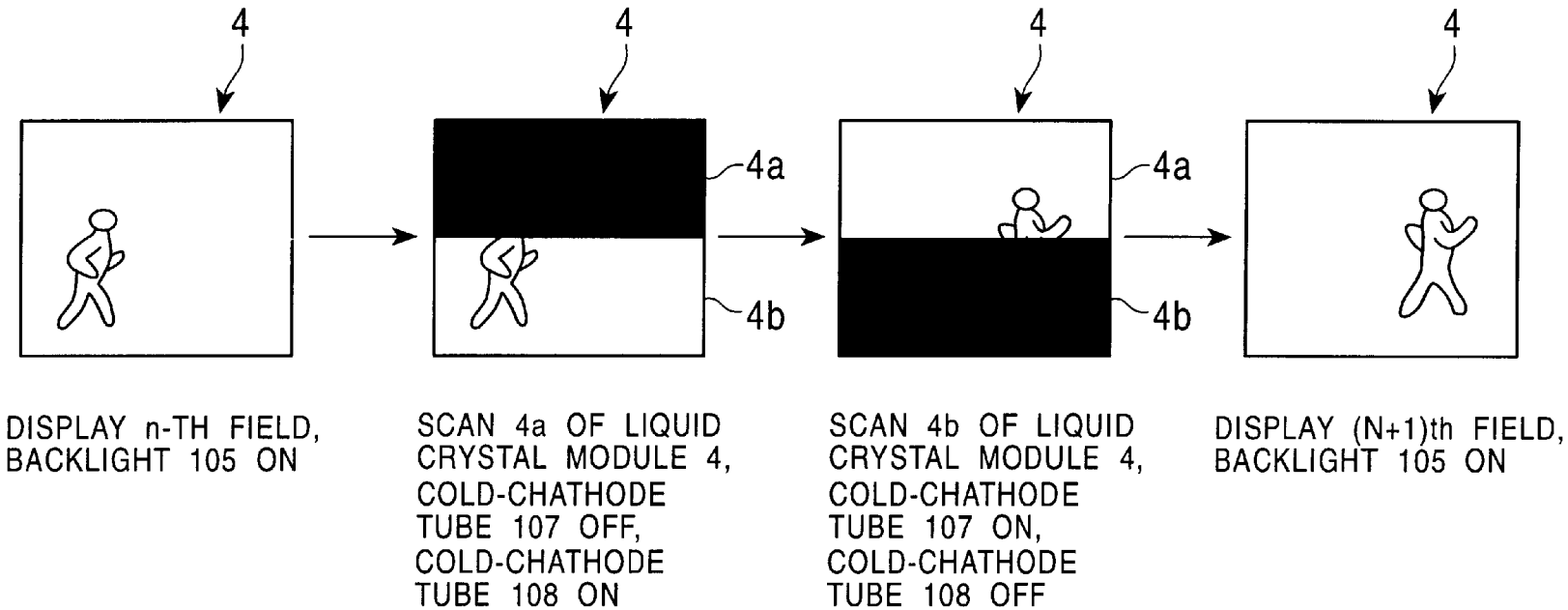
FIG. 8 is a schematic illustration of a liquid crystal display method according to the second embodiment.

FIG. 8 is a schematic illustration of a liquid crystal display method according to the second embodiment. Referring to FIG. 8, in the first screen, an image of the n-th field is displayed on the liquid crystal module 4. A transition from the n-th field to the (n+1)th field occurs in the following procedure. First, the inverter 15 turns off the cold-cathode tube 107 while leaving the other cold-cathode tube 108 turned on. Accordingly, as in the second screen, a half area 4*a* of the liquid crystal module 4 is rendered dark, while the other half area 4*b* remains bright so as to hold the image of the n-th field within the area. Then, a scanning for an image of the (n+1)th field begins with the half area 4*a*. When the half area 4*a* has been completely scanned, the inverter 15 next turns on the cold-cathode tube 107 while turning off the cold-cathode tube 108. Accordingly, as in the third screen, the half area 4*a* of the liquid crystal module 4 is rendered bright with an image of the (n+1)th field within the area, while the other half is rendered dark. Thereupon, the scanning for the display of the (n+1)th field proceeds to the other half area 4*b*. When the half area 4*b* is completely scanned, the inverter 15 turns on the cold-cathode tube 108 so as to render the half area 4*b* bright. Accordingly, as in the fourth screen, the whole image of the (n+1)th field is displayed for viewing.

In the second embodiment, each of the cold-cathode tubes 107 and 108 is turned off only while the associated area, 4*a* and 4*b*, respectively, of the liquid crystal module 4 is being scanned. Accordingly, the backlight is turned off for a relatively shorter period in each area of the liquid crystal module 4, further improving picture quality in addition to eliminating afterimages such as trailing.

In the embodiments described above, the backlights 5 and 105 are controlled based on pulse-width modulated signals which are in synchronization with vertical synchronization signals. By controlling the backlights 5 and 105 in synchronization with the image fields, the liquid crystal display apparatuses of the embodiments eliminate trailing, which arises when a moving image varying over time is displayed on the liquid crystal module 4, thus improving picture quality.

The present invention is not limited to the above-described embodiments, and it may be embodied with various modifications including, but not limited to, the following.

Although the time delay control unit 13 is provided in the vertical synchronization signal processing unit 12 in the described embodiments, vertical synchronization signals may alternatively be fed directly to the duty ratio control unit 14.

The backlights 5 and 105 may be driven by generating pulse-width modulated signals having a frequency twice as high as that of vertical synchronization signal of video signals. In that case, the refresh rate of the liquid crystal module 4 must also be doubled, so that the backlights 5 and 105 is turned off while the liquid crystal module 4 is being scanned.

The video signals transmitted from the video signal output apparatus 2 may be either digital or analog.

The waveguide plate 105*a* of the backlight 105, divided into two areas by the light block 106 in the second embodiment, may alternatively be divided into more than two areas. In that case, each of the divided areas of the waveguide 105*a* must be provided with at least one cold-cathode tube, each cold-cathode tube being controlled by the inverter 15 so as to be turned off while the associated area of the liquid crystal module 4 is being scanned.

The functionalities of the time delay control unit 13 and the duty ratio control unit 14 may be implemented either by hardware, such as multivibrators, as in the embodiments, or by any equivalent software.

What is claimed is:

1. A liquid crystal display apparatus comprising:

a control unit for processing a video signal;

a liquid crystal module controlled by said control unit for displaying an image thereon;

a backlight unit for emitting light onto a rear surface of said liquid crystal module;

a vertical synchronization signal processing unit for generating pulse signals based on a vertical synchronization signal of each field of said video signal, said pulse signals being pulse-width modulated and in synchronization with said vertical synchronization signal; and an inverter unit for generating, at a predetermined oscillation frequency, a voltage signal for driving said backlight unit, so as to turn on said backlight unit while an image of a field is displayed on said liquid crystal module and to turn off said backlight while scanning an image of a next field on said liquid crystal module, based on said pulse signals.

2. The liquid crystal display apparatus according to claim 1, wherein said vertical synchronization signal processing unit includes a time delay control unit for delaying output of said pulse signals from said vertical synchronization signal processing unit for a predetermined period of time.

3. The liquid crystal display apparatus according to claim 1, wherein said vertical synchronization signal processing unit operates only when said video signal represents a moving image.

4. The liquid crystal display apparatus according to claim 1, wherein said backlight unit includes:

a waveguide member;

a plurality of cold-cathode tubes disposed within said waveguide member; and a light-blocking member provided in said waveguide member for blocking transmission of light within said waveguide member, wherein the light is emitted from said plurality of cold-cathode tubes.

5. The liquid crystal display apparatus according to claim 4, wherein said inverter unit includes means for controlling each of said plurality of cold-cathode tubes independently.

6. A display method for displaying an image on a liquid crystal module in accordance with a video signal input thereto, the method comprising the steps of:

generating pulse signals based on a vertical synchronization signal of each field of said video signal, said pulse signals being pulse-width modulated and in synchronization with said vertical synchronization signal;

generating voltages based on said pulse signals, at a predetermined oscillation frequency; and driving, with said voltages, a backlight unit so as to turn on said backlight and emit light onto a rear surface of said liquid crystal module while an image of a field is displayed on said liquid crystal module and to turn off said backlight off when a scanning of an image of a next field on said liquid crystal module is performed.

7. The display method according to claim 6, further comprising the step of:

delaying output of said pulse signals following said step of generating for a predetermined period of time.

8. The display method according to claim 6, wherein said displaying an image is active only when said video signal represents a moving image.

* * * * *